US010710381B2

(12) United States Patent
Kawai et al.

(10) Patent No.: US 10,710,381 B2
(45) Date of Patent: Jul. 14, 2020

(54) INKJET PRINTER

(71) Applicant: MIMAKI ENGINEERING CO., LTD., Nagano (JP)

(72) Inventors: Tomoya Kawai, Nagano (JP); Katsutoshi Yamabe, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 16/403,621

(22) Filed: May 6, 2019

(65) Prior Publication Data

US 2019/0344586 A1 Nov. 14, 2019

(30) Foreign Application Priority Data

May 11, 2018 (JP) ..... 2018-091847

(51) Int. Cl.
*B41J 11/00* (2006.01)
*B41J 2/01* (2006.01)
*B41J 29/02* (2006.01)

(52) U.S. Cl.
CPC ..... *B41J 11/002* (2013.01); *B41J 2/01* (2013.01); *B41J 29/02* (2013.01)

(58) Field of Classification Search
CPC ..... B41J 11/002; B41J 11/0015; B41J 29/02; B41J 2/01
USPC ..... 347/101, 102, 104
See application file for complete search history.

(56) References Cited

U.S. PATENT DOCUMENTS 8,186,797 B2 * 5/2012 Okura ..... B41J 11/0005 347/102
9,010,920 B2 * 4/2015 Nishimura ..... B41J 11/002 347/102
9,884,486 B2 * 2/2018 Harayama ..... B41J 11/0015

FOREIGN PATENT DOCUMENTS

JP 2005349632 12/2005
JP 2013119214 6/2013
JP 201835481 3/2018

OTHER PUBLICATIONS

"Search Report of Europe Counterpart Application", dated Sep. 11, 2019, p. 1-p. 9.

* cited by examiner

*Primary Examiner* — An H Do
(74) *Attorney, Agent, or Firm* — JCIPRNET

(57) ABSTRACT

An inkjet printer is provided. An inkjet printer includes; a heater for heating up a medium after a printing operation, a second heater for further heating up the medium after the medium is heated up by the heater, a frame to which the second heater is fixed, and a wound roll holder for holding a wound roll that is the medium, being wound like a roll after the printing operation. The wound roll is placed at a position lower than the heater. The second heater is movable in relation to the frame, between a first position, where the second heater is placed at a location of a lower side of the heater and a front side of the wound roll, and a second position, where the second heater is placed at a location of an upper side of the wound roll.

10 Claims, 3 Drawing Sheets

INKJET PRINTER

CROSS REFERENCE TO RELATED APPLICATIONS

This application claims the priority benefit of Japanese Patent Application No. 2018-091847 filed on May 11, 2018. The entirety of the above-mentioned patent application is hereby incorporated by reference herein and made a part of this specification.

TECHNICAL FIELD

The present disclosure relates to an inkjet printer that carries out a printing operation by way of discharging an ink drop onto a medium.

DESCRIPTION OF THE BACKGROUND ART

Conventionally, known is an inkjet printer that carries out a printing operation for a cloth (for example, refer to Patent Document 1). An inkjet printer described in Patent Document 1 includes an inkjet unit, a cloth feeding unit, and a heater unit. The inkjet unit includes an inkjet head, and a carriage in which the inkjet head is installed. The cloth feeding unit includes a feeding roller, a winding roller and a platen.

Furthermore, in the inkjet printer described in Patent Document 1, the heater unit includes a platen heater for heating up the platen, a pre-heater for preheating the cloth before the printing operation, and an after-heater for after-heating the cloth at a position between the platen and the winding roller. By way of heating the cloth, the after-heater heats up the ink discharged onto the cloth from the inkjet head, in order to dry the ink. Incidentally, the after-heater is located at an upper side of the winding roller.

[Patent Document 1] Japanese Unexamined Patent Application Publication No. 2018-35481

In the case of the inkjet printer described in Patent Document 1, sometimes it may happen that the ink discharged onto the cloth from the inkjet head cannot be sufficiently dried by the after-heater, owing to an influence of characteristics of the ink discharged from the inkjet head, a property of the cloth, and the like. In such a case, it becomes possible to sufficiently dry the ink by way of additionally installing a heater for heating up the cloth, at a lower side of the after-heater. If such a heater is additionally installed at a lower side of the after-heater, there exists a risk that the cloth wound on the winding roller after the printing operation unfortunately interferes with the heater additionally installed, at a time of dismounting the cloth wound on the winding roller after the printing operation, so that it may become impossible to easily dismount the cloth after the printing operation.

Then, the present disclosure provides an inkjet printer with which it is possible to easily dismount a medium wound around so as to be like a roll after printing operation, and in the meantime ink discharged onto the medium from an inkjet head can sufficiently be dried.

SUMMARY

In order to solve the issue described above, an inkjet printer according to the present disclosure includes: an inkjet head for printing operation by way of discharging an ink drop onto a medium, a heater for heating up the medium after the printing operation, a second heater for further heating up the medium after the medium is heated up by the heater, a frame to which the second heater is fixed, and a wound roll holder for holding a wound roll that is the medium, being wound like a roll after the printing operation; wherein, provided that an axial direction of the wound roll is represented as a right-and-left direction, and a direction perpendicular to a vertical direction and the right-and-left direction is represented as a front-and-back direction; the wound roll is placed at a position lower than the heater; and the second heater is movable in relation to the frame, between a first position, where the second heater is placed at a location of a lower side of the heater and a front side of the wound roll, and a second position, where the second heater is placed at a location of an upper side of the wound roll.

The inkjet printer according to the present disclosure includes the second heater for further heating up the medium after the medium is heated up by the heater. Therefore, according to the present disclosure, the ink discharged onto the medium from the inkjet head can sufficiently be dried. Moreover, according to the present disclosure, the wound roll that is the medium, being wound like a roll after the printing operation is placed at the position lower than the heater; and meanwhile, the second heater is movable in relation to the frame, between the first position, where the second heater is placed at the location of a lower side of the heater and the front side of the wound roll, and the second position, where the second heater is placed at the location of an upper side of the wound roll. Therefore, according to the present disclosure; with the second heater having been moved to the second position, the wound roll can easily be dismounted toward a front side. In other words, according to the present disclosure, it is possible to easily dismount a medium wound around so as to be like a roll after printing operation, and in the meantime the ink discharged onto the medium from an inkjet head can sufficiently be dried.

In the present disclosure, it is preferable that the second heater is rotatable in relation to the frame, with a right-and-left direction as an axial direction of a rotary movement, between the first position and the second position. According to this configuration, it becomes possible to move the second heater between the first position and the second position, by use of a comparatively simple configuration.

In the present disclosure, it is preferable that, at a time when the second heater is placed at the second position, the second heater and the heater face each other across a clearance, and the medium after printing operation passes through between the second heater and the heater. According to this configuration; even when the second heater is placed at the second position, it becomes possible to effectively heat up the medium by use of the second heater.

In the present disclosure, it is preferable that the inkjet printer further includes a cable connected to the second heater, and a heater holding member to which an end part of the second heater in the right-and-left direction is fixed; and the cable is led from the heater holding member, outward in a right-and-left direction. According to this configuration, it easily becomes possible to prevent the cable led out of the heater holding member from interfering with a peripheral structure of the second heater, at a time when the second heater rotates between the first position and the second position.

In the present disclosure, it is preferable that, in the second heater, there is formed a medium contacting surface that the medium contacts at a time when the second heater is placed at the first position. According to this configuration, in comparison to a case where a clearance is made between the second heater placed at the first position and the medium, it becomes possible to effectively heat up the medium so as to effectively dry the ink.

ADVANTAGEOUS EFFECT OF THE INVENTION

As described above, with respect to the inkjet printer according to the present disclosure, it becomes possible to easily dismount a medium wound around so as to be like a roll after printing operation, and in the meantime ink discharged onto the medium from an inkjet head can sufficiently be dried.

DESCRIPTION OF THE EMBODIMENTS

A preferred embodiment according to the present disclosure is explained below with reference to the drawings.

Schematic Configuration of Inkjet Printer

Figure 1:
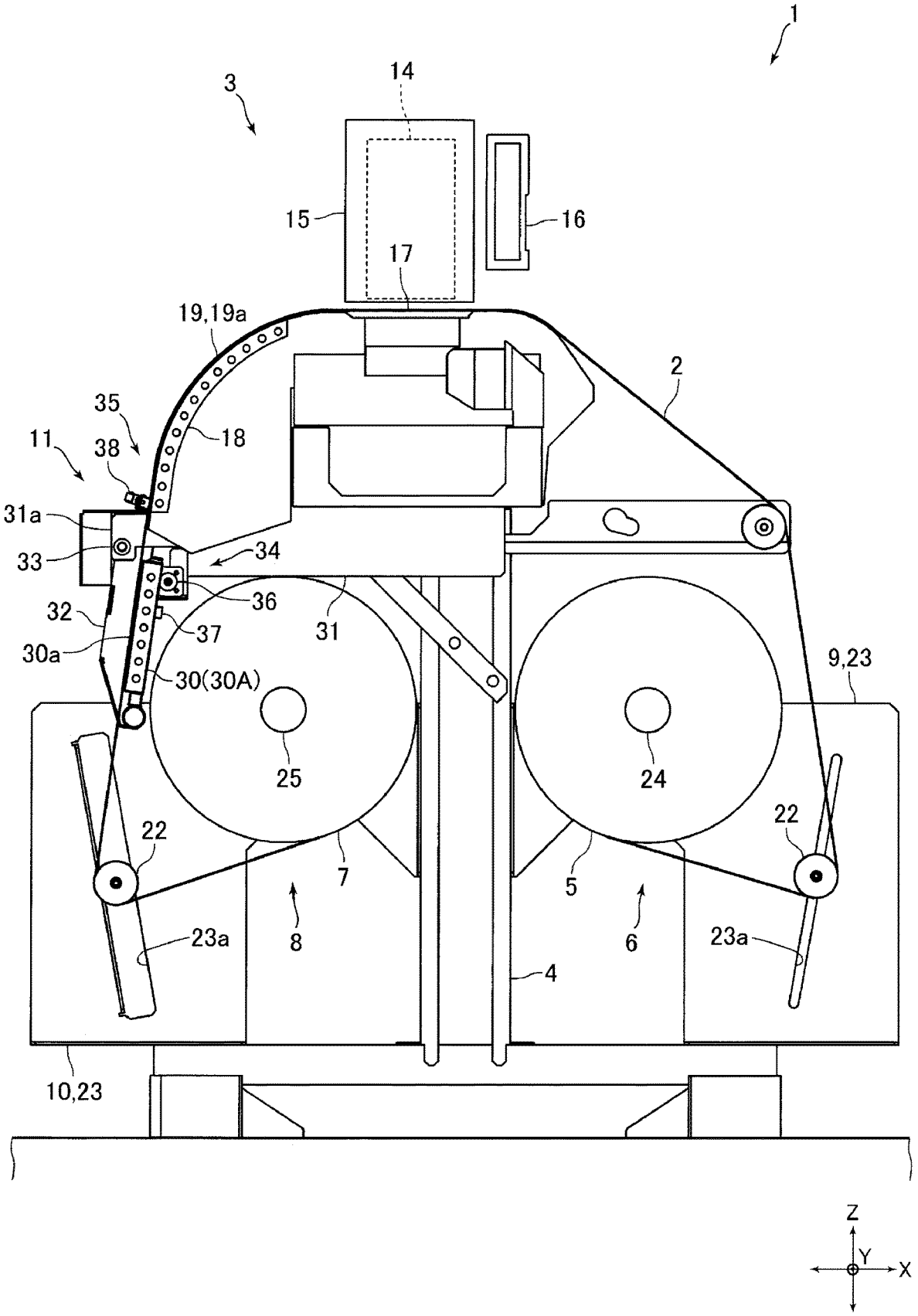
FIG. 1 is a side view drawing for explaining a configuration of an inkjet printer according to an embodiment of the present disclosure.

FIG. 1 is a side view drawing for explaining a configuration of an inkjet printer 1 according to an embodiment of the present disclosure.

The inkjet printer 1 (hereinafter, referred to as a "printer 1") of the present embodiment is an inkjet printer for business use. The printer 1 includes: a printer main body 3 for printing onto a medium 2, being elongated (i.e., the medium 2 being formed like a sheet), which is made of paper, cloth, and the like; a supporting member 4 for supporting the printer main body 3 from a lower side; a feeding roll holder 6 for holding a feeding roll 5 that is the medium 2, being wound like a roll before a printing operation; a wound roll holder 8 for holding a wound roll 7 that is the medium 2, being wound like a roll after the printing operation; a tension applying mechanism 9 that applies tension to the medium 2 by way of contacting the medium 2 before the printing operation; a tension applying mechanism 10 that applies tension to the medium 2 by way of contacting the medium 2 after the printing operation; and a heater unit 11 that is installed in the supporting member 4 in such a way as to be removable.

The printer main body 3 includes: an inkjet head 14 (hereinafter, referred to as a "head 14") for printing operation by way of discharging an ink drop onto the medium 2; a carriage 15 in which the head 14 is installed; a carriage drive mechanism (not illustrated) for transferring the carriage 15 in a main scanning direction (i.e., a Y-direction in FIG. 1 and so on); and a supporting frame 16 that supports the carriage 15 in such a way as to be movable in the main scanning direction. Furthermore, the printer main body 3 includes a print platen 17 placed at location of a lower side of the carriage 15, and a heater 18 for heating up the medium 2 after the printing operation.

The head 14 discharges an ink drop downward. On the print platen 17, there is placed the medium 2 for printing operation at the time. Moreover, the printer main body 3 further includes a medium transfer mechanism (not illustrated) for transferring the medium 2 placed on the print platen 17 in a sub-scanning direction (i.e., an X-direction in FIG. 1 and so on) that is perpendicular to a vertical direction (i.e., a Z-direction in FIG. 1 and so on) and the main scanning direction. In the following explanation, the main scanning direction (Y-direction) is represented as a "right-and-left direction", and the sub-scanning direction (X-direction) is represented as a "front-and-back direction". The medium 2 before printing operation is transferred onto a top surface of the print platen 17 from a rear side, and the medium 2 after printing operation is transferred from the top surface of the print platen 17 to a front side.

At a front side of the print platen 17, there is placed an after platen 19. On a surface of the after platen 19, there is formed a guide surface 19*a* for guiding the medium 2 to be transferred toward the wound roll holder 8 from the print platen 17. The guide surface 19*a* is shaped so as to be convex curved, roughly having a shape of a quarter of a circle in a view from a right-and-left direction. A front end of the print platen 17 is connected to a rear end of the guide surface 19*a*. The medium 2, transferred from the print platen 17 toward the wound roll holder 8, contacts the guide surface 19*a*.

The heater 18 has a heater wire (cord heater). The heater 18 is placed inside the after platen 19, in such a way as to go along the guide surface 19*a*. In other words, the heater 18 is placed at a rear side of the guide surface 19*a*, in such a way as to go along the guide surface 19*a*.

The tension applying mechanisms 9 and 10 are located at a position lower than the printer main body 3. Then, the tension applying mechanism 9 is fixed to the supporting member 4 at a rear side of the printer main body 3, and meanwhile the tension applying mechanism 10 is fixed to the supporting member 4 at a front side of the printer main body 3. The tension applying mechanism 9 includes a tension bar 22 for applying a tension to the medium 2 by way of contacting the medium 2 before printing operation, and a frame 23 in which a guide groove 23*a*, being like a slit, for guiding the tension bar 22 in a vertical direction is shaped. The tension bar 22 applies a tension to the medium 2 by way of contacting the medium 2 from an upper side, before printing operation.

The tension applying mechanism 10 is configured in the same way as the tension applying mechanism 9; and namely includes the tension bar 22 for applying a tension to the medium 2 by way of contacting the medium 2 after printing operation, and the frame 23 in which the guide groove 23*a*, being like a slit, for guiding the tension bar 22 in a vertical direction is shaped. The tension bar 22 of the tension applying mechanism 10 applies a tension to the medium 2 by way of contacting the medium 2 from an upper side, after printing operation.

The feeding roll holder 6 is placed at a location of a lower side of the printer main body 3. The feeding roll holder 6 includes a turning shaft 24 to be inserted into an inner circumferential side of the feeding roll 5, and a drive mechanism (not illustrated) for turning the turning shaft 24. The feeding roll 5 is placed in such a way that an axial direction of the feeding roll 5 is consistent with a right-and-left direction. Both end parts of the turning shaft 24 are so supported as to be rotatable, by the frame 23 of the tension applying mechanism 9.

The wound roll holder 8 is placed at a location of a lower side of the printer main body 3, and placed at the location being lower than the heater 18. In the present embodiment, the wound roll holder 8 is placed at a location of a lower side of the heater 18. The wound roll holder 8 includes a turning shaft 25 to be inserted into an inner circumferential side of the wound roll 7, and a drive mechanism (not illustrated) for turning the turning shaft 25. The wound roll 7 is placed in such a way that an axial direction of the wound roll 7 is consistent with a right-and-left direction. In other words, the right-and-left direction (Y-direction) is the axial direction of the wound roll 7. Both end parts of the turning shaft 25 are so supported as to be rotatable, by the frame 23 of the tension applying mechanism 10.

Incidentally, a maximum outer diameter of the feeding roll 5, being brand-new, to be set at the feeding roll holder 6 is for example, roughly in a range of 500 (mm) through 600 (mm). On the other hand, a maximum outer diameter of the wound roll 7 to be wound at the wound roll holder 8 is almost the same as the maximum outer diameter of the feeding roll 5, being brand-new, to be set at the feeding roll holder 6; and the outer diameter is for example, roughly in a range of 500 (mm) through 600 (mm).

Configuration of Heater Unit

Figure 2:
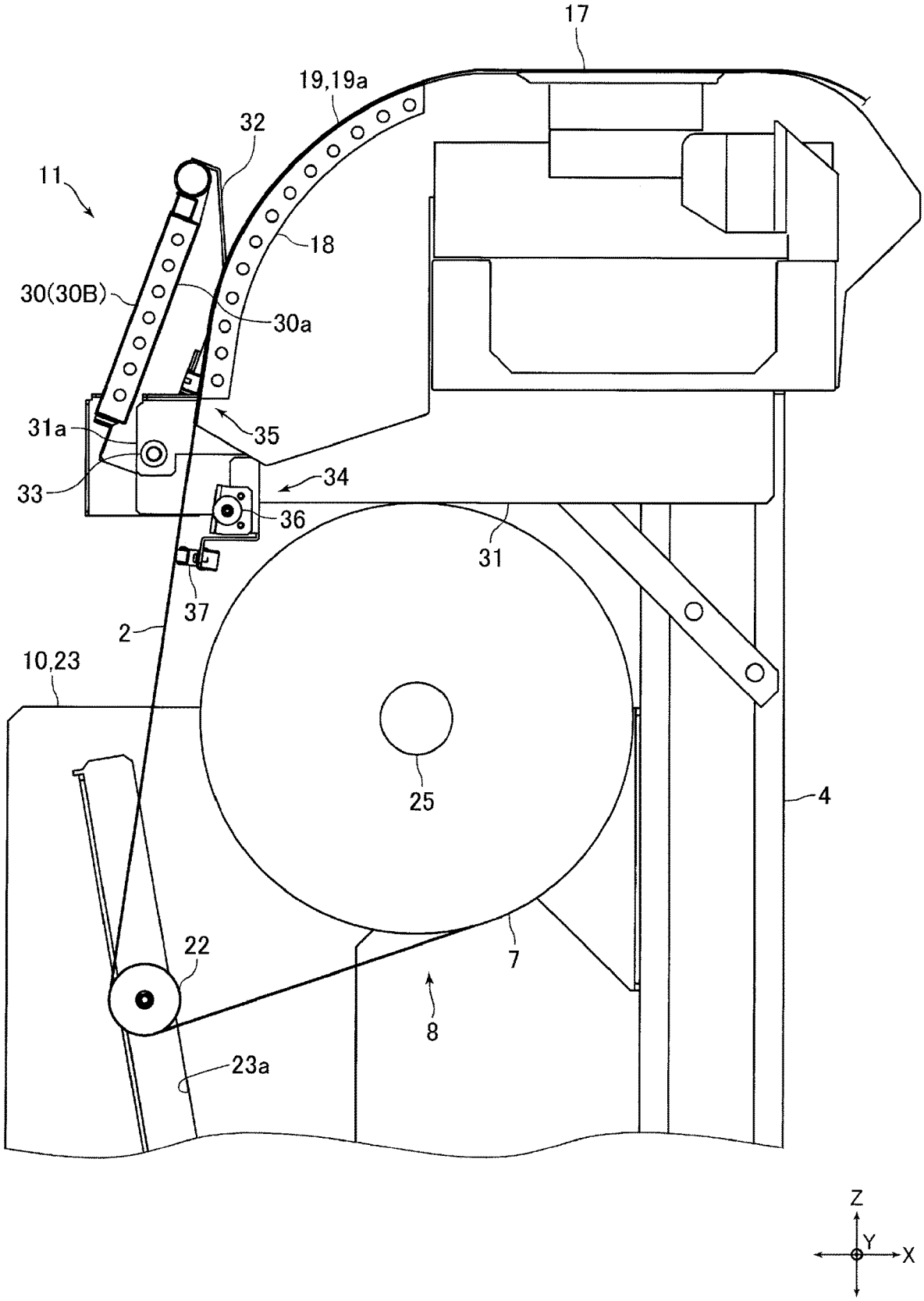
FIG. 2 is a side view drawing for explaining a state in which a second heater, shown in FIG. 1, is placed at a second position.
Figure 3:
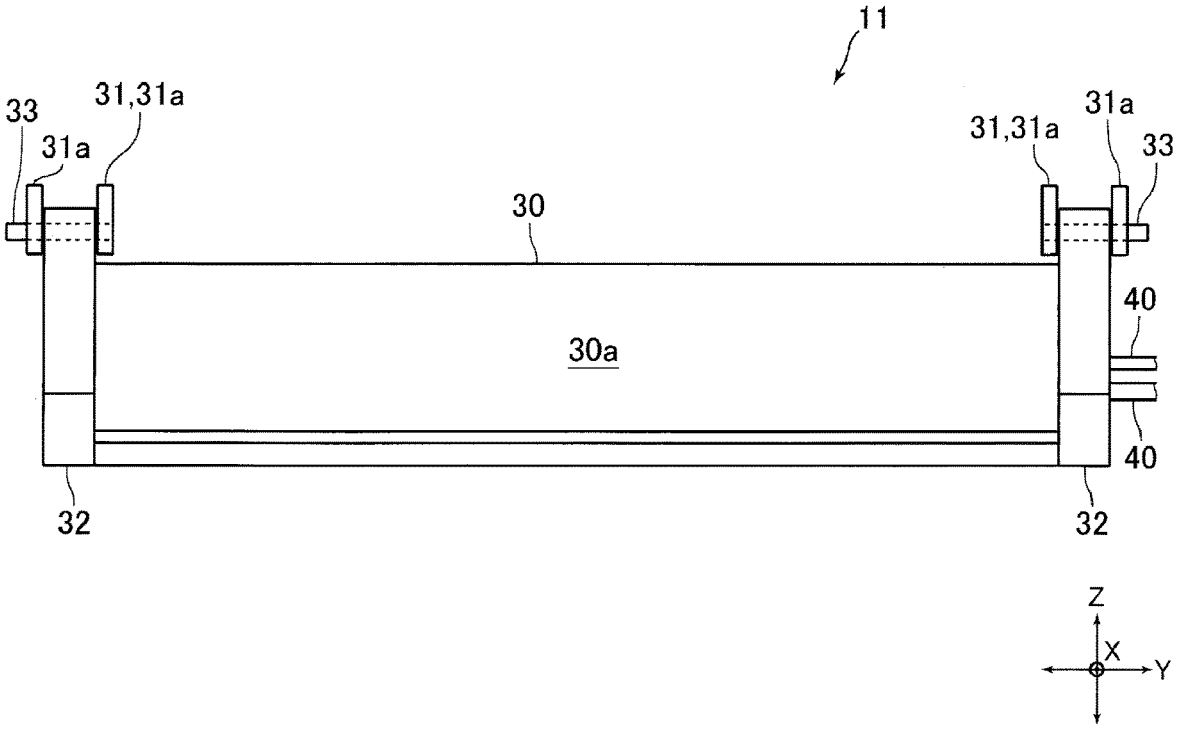
FIG. 3 is a front elevation view drawing for explaining a configuration of a heater unit shown in FIG. 1.

FIG. 2 is a side view drawing for explaining a state in which a heater 30, shown in FIG. 1, is placed at a second position 30B. FIG. 3 is a front elevation view drawing for explaining a configuration of the heater unit 11 shown in FIG. 1.

The heater unit 11 includes the heater 30 for further heating up the medium 2 after the medium 2 is heated up by the heater 18, and a frame 31 to which the heater 30 is fixed. The heater 30 includes a heater wire and a case in which the heater wire is stored. The case of the heater 30 is shaped like a cuboid box flattened having a long dimension in a right-and-left direction in such a way that the heater 30 is shaped like a rectangular flat board, as a whole, with a long dimension in the right-and-left direction. A width of the heater 30 in the right-and-left direction is a dimension corresponding to a width of the medium 2 in the right-and-left direction. Then, the width of the heater 30 in the right-and-left direction is almost equal to a width of the heater 18 in the right-and-left direction. The heater 30 of the present embodiment is a second heater.

Moreover, the heater unit 11 includes a heater holding member 32 to which each end part of the heater 30 in the right-and-left direction is fixed. Concretely to describe, the heater unit 11 includes two heater holding members 32 to which both end parts of the heater 30 in the right-and-left direction are individually fixed. Both the end parts of the heater 30 in the right-and-left direction are fixed to the heater holding members 32, and then the heater 30 is fixed to the frame 31 by the intermediary of the heater holding members 32.

The frame 31 is located at each of both end sides of the heater 30 in the right-and-left direction (refer to FIG. 3). In other words, the heater unit 11 includes two frames 31. The frames 31 stretch frontward from a top end part of the supporting member 4. A rear end part of the frames 31 is fixed to the top end part of the supporting member 4. Incidentally, the rear end part of the frames 31 is fixed to the top end part of the supporting member 4 by use of a screw (not illustrated), so that the frames 31 are removable in relation to the supporting member 4.

At a front end part of the frame 31, there is formed a shaft holding part 31*a* that holds a rotary shaft 33, fixed to the heater holding members 32, in such a way as to be rotatable. The heater 30 and the heater holding members 32 are so held as to be rotatable by the shaft holding part 31*a*, by the intermediary of the rotary shaft 33. The rotary shaft 33 is placed in such a way an axial direction of the rotary shaft 33 is consistent with a right-and-left direction. In other words, the heater 30 and the heater holding members 32 are held by the shaft holding part 31*a*, so as to enable a rotary movement with the right-and-left direction as the axial direction of the rotary movement; while being rotatable in relation to the frame 31, with the right-and-left direction as the axial direction of the rotary movement, and with the rotary shaft 33 as a rotation center.

The rotary shaft 33 is located at a position higher than the wound roll 7. Furthermore, the rotary shaft 33 is located at a side more frontward than the wound roll 7. Incidentally, as shown in FIG. 3, the rotary shaft 33 is fixed to each of the two heater holding members 32. Then, each one rotary shaft 33 is so held as to be rotatable by use of two shaft holding parts 31*a*.

In the present embodiment, the heater 30 is rotatable in relation to the frame 31, with the right-and-left direction as the axial direction of the rotary movement; between a first position 30A (a position shown in FIG. 1), where the heater 30 is placed at a location of a lower side of the heater 18 and a front side of the wound roll 7, and a second position 30B (a position shown in FIG. 2), where the heater 30 is placed at a location of an upper side of the wound roll 7. In other words, the heater 30 is movable in relation to the frame 31, between the first position 30A and the second position 30B. In the present embodiment, an operator manually rotates the heater 30 between the first position 30A and the second position 30B.

Furthermore, in the present embodiment; if the heater 30 being placed at the first position 30A rotates approximately 180 degrees clockwise in a state shown in FIG. 1, the heater 30 moves to the second position 30B. On the other hand, if the heater 30 being placed at the second position 30B rotates approximately 180 degrees counterclockwise in a state shown in FIG. 2, the heater 30 moves to the first position 30A. The heater unit 11 includes a holding mechanism 34 for holding the heater 30 at the first position 30A, and a holding mechanism 35 for holding the heater 30 at the second position 30B. Moreover, the heater unit 11 is provided with a damper (not illustrated) for preventing the heater 30 from rapidly rotating out of the second position 30B to the first position 30A. The damper is a rotary damper, which is provided to the rotary shaft 33. Incidentally, the damper is, for example a disk damper.

When the heater 30 is placed at the first position 30A, a thickness direction of the heater 30 shaped like a flat board is almost consistent with a front-and-back direction. Concretely to describe; when the heater 30 is placed at the first position 30A, the heater 30 is tilted a little in such a way that; the lower a location is, the more the location is shifted toward a front side. When the heater 30 is placed at the first position 30A, a rear surface of the medium 2, being transferred to the wound roll holder 8, contacts a front surface of the heater 30. In other words; in the heater 30, there is formed a medium contacting surface 30*a* that the medium 2 contacts at the time when the heater 30 is placed at the first position 30A; and the front surface of the heater 30, at the time when the heater 30 is placed at the first position 30A, works as the medium contacting surface 30*a*.

When the heater 30 is placed at the first position 30A, the medium 2 being transferred from the print platen 17 toward the wound roll holder 8 passes over the guide surface 19*a*, the medium contacting surface 30*a*, and the tension bar 22 in this sequence. Incidentally, when the heater 30 is placed at the first position 30A, the rotary shaft 33 is located at a position of a diagonally-front-upward side in relation to an upper end of the medium contacting surface 30*a*, and a front-upper-end part of the heater holding member 32 is held by the shaft holding part 31*a*, by the intermediary of the rotary shaft 33. Moreover, when the heater 30 is placed at the first position 30A, a front surface of the heater holding member 32 is placed at a position more frontward than the medium contacting surface 30*a*.

When the heater 30 is placed at the second position 30B, the heater 30 and the heater 18 face each other across a clearance, as shown in FIG. 2. Concretely to describe, the heater 30 placed at the second position 30B and a lower part of the heater 18 face each other across the clearance almost in a front-and-back direction. The clearance between the heater 30 and the heater 18 in the front-and-back direction is about 20 to 30 mm. Then, at a time when the heater 30 is placed at the second position 30B, the medium 2 after printing operation passes through between the heater 30 and the heater 18. Incidentally, when the heater 30 is placed at the second position 30B, the rotary shaft 33 is located at a position of a diagonally-rear-downward side in relation to a lower end of the medium contacting surface 30*a*, and a rear-lower-end part of the heater holding member 32 is held by the shaft holding part 31*a*, by the intermediary of the rotary shaft 33.

The holding mechanism 34 includes: a stopper member 36, made of rubber, which either the heater 30 or a rear surface of the heater holding member 32 contacts at the time when the heater 30 is placed at the first position 30A; and a latch mechanism 37 for locking the heater holding member 32. The holding mechanism 34 is placed at a rear side of an upper end part of the heater 30, when the heater 30 is placed at the first position 30A. Meanwhile, in a similar way as the holding mechanism 34, the holding mechanism 35 includes: a stopper member, made of rubber, which contacts the rear surface of the heater holding member 32, at the time when the heater 30 is placed at the second position 30B; and a latch mechanism 38 for locking the heater holding member 32. The holding mechanism 35 is placed at a rear side of a lower end part of the heater holding member 32, at the time when the heater 30 is placed at the second position 30B. The holding mechanism 34 and the holding mechanism 35 are fixed to the frame 31, by the intermediary of a predetermined member.

To the heater 30, a cable 40 is connected (refer to FIG. 3). For example, two cables 40 are connected to the heater 30. The cables 40 are led from the heater holding member 32, outward in a right-and-left direction. For example, the cables 40 are led toward a right-hand side out of a right-side surface of the heater holding member 32 placed at a right side. The cables 40 led from the heater holding member 32 are introduced into a wiring box (not illustrated) that is fixed to the supporting member 4.

In the printer 1, at a time when printing operation for the medium 2 is carried out, the heater 30 is placed at the first position 30A; so as to further heat up the medium 2 after heating up by the heater 18, in such a way as to dry the ink discharged onto the medium 2. Meanwhile, sometimes the heater 30 is placed at the second position 30B at a time when printing operation for the medium 2 is carried out. In this case, passing between the heater 30 and the heater 18, the medium 2 is heated up by the heater 30 and the heater 18 in such a way as to dry the ink discharged onto the medium 2. Moreover, at a time of dismounting the wound roll 7 out of the wound roll holder 8, the heater 30 is placed at the second position 30B. Then, the wound roll 7 is dismounted toward a front side.

Incidentally, as described above, the frame 31 is fixed to the supporting member 4 in such a way as to be removable, so that the heater unit 11 is removable in relation to the supporting member 4. With respect to the printer 1; for example, a state where the heater unit 11 is removed may be defined as a standard configuration of the printer 1, and the heater unit 11 may be dealt with as an option of the printer 1. In this case, by way of additionally installing the heater unit 11 as an option to the standard configuration of the printer 1, the medium 2 after printing operation can effectively be heated up.

Primary Effect of the Present Embodiment

As described above, the printer 1 according to the present embodiment is provided with the heater 30 in addition to the heater 18. Therefore, according to the present embodiment, it becomes possible to sufficiently dry the ink discharged onto the medium 2 from the head 14; by way of further heating up the medium 2 that has been heated up with the heater 18, by use of the heater 30 placed at the first position 30A; or by way of effectively heating up the medium 2, which passes between the heater 30 placed at the second position 30B and the heater 18, by use of the heater 30 and the heater 18.

Moreover, according to the present embodiment; the heater 30 is placed at the second position 30B where the heater 30 is located at a side being higher than the wound roll 7, at the time of dismounting the wound roll 7 out of the wound roll holder 8; and therefore the wound roll 7 can easily be dismounted toward a front side. In other words, according to the present embodiment; it becomes possible to easily dismount the wound roll 7, and in the meantime, the ink discharged onto the medium 2 from the head 14 can sufficiently be dried. Furthermore, according to the present embodiment; even when the heater 30 is placed at the second position 30B, it becomes possible to effectively heat up the medium 2 by use of the heater 30.

According to the present embodiment; when the heater 30 is placed at the first position 30A, the medium 2 being transferred toward the wound roll holder 8 contacts the medium contacting surface 30*a* of the heater 30. Therefore, in comparison to a case where a clearance is made between the heater 30 placed at the first position 30A and the medium 2; according to the present embodiment, it becomes possible to effectively heat up the medium 2 so as to effectively dry the ink.

In the present embodiment, the heater 30 is rotatable in relation to the frame 31, with the right-and-left direction as the axial direction of the rotary movement, between the first position 30A and the second position 30B. Therefore, according to the present embodiment; it becomes possible to move the heater 30 between the first position 30A and the second position 30B, by use of a comparatively simple configuration. Furthermore, according to the present embodiment; the cables 40 are led from the heater holding member 32, outward in the right-and-left direction so that it becomes easy to prevent the cables 40, led out of the heater holding member 32, from interfering with a peripheral structure of the heater 30, at the time when the heater 30 rotates between the first position 30A and the second position 30B.

Other Embodiment

Though the embodiment described above is an example of a preferred embodiment according to the present disclosure, the present disclosure is not restricted to the embodiment; and various modifications can be made within a scope having no alteration in the gist of the present disclosure.

Figure 4:
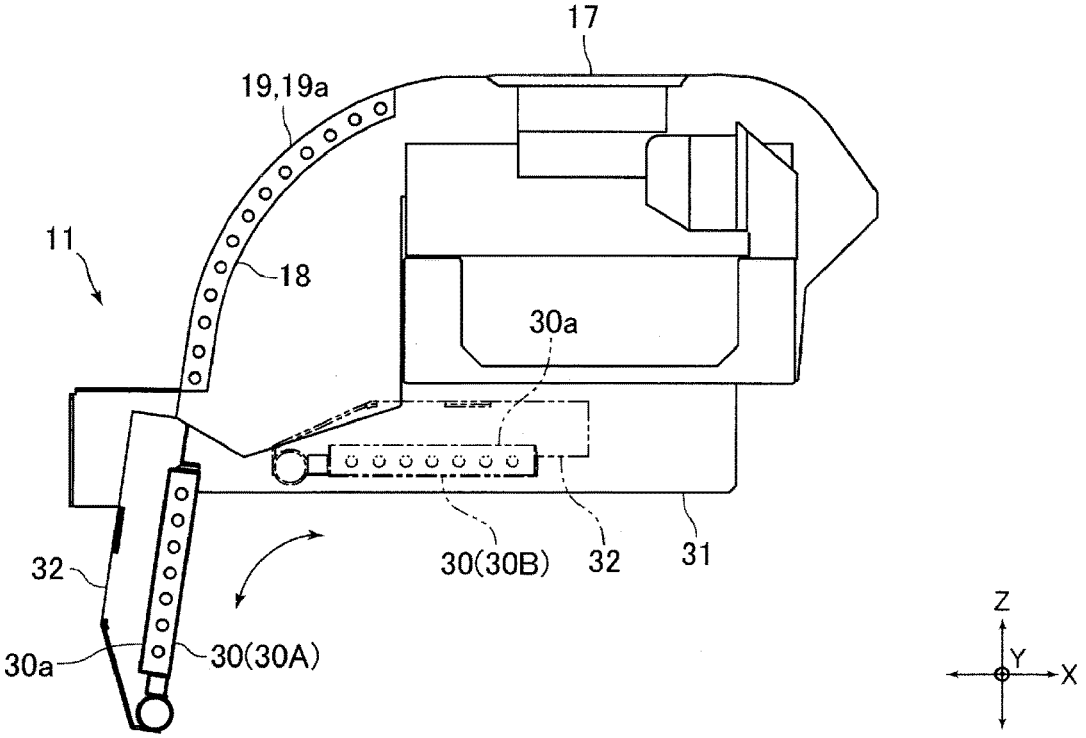
FIG. 4 is a side view drawing for explaining a configuration of a heater unit according to another embodiment of the present disclosure.

In the embodiment described above, for example as shown in FIG. 4, the heater 30 may move between the first position 30A and the second position 30B, by way of sliding in a front-and-back direction while rotating in relation to the frame 31, with the right-and-left direction as the axial direction of the rotary movement. In this case, the heater 30 being placed at the second position 30B is, for example, placed there in such a way that a thickness direction of the heater 30 is consistent with a vertical direction, and the heater 30 is placed right above the wound roll 7.

Furthermore, in this case; for example, a predetermined cam groove is shaped in the frame 31, and a cam follower that engages with the cam groove is fixed to the heater holding member 32. Alternatively, the heater holding member 32 and the frame 31 are connected each other by the intermediary of a predetermined link mechanism. Moreover, in this case; the medium 2 is not heated up by the heater 30 placed at the second position 30B. Furthermore, for example, the heater 30 may vertically slide in relation to the frame 31, between the first position 30A and the second position 30B.

In the embodiment described above, at the time when the heater 30 is placed at the first position 30A, there may be made a clearance between the medium 2 being transferred toward the wound roll holder 8 and the front surface of the heater 30. Moreover, in the embodiment described above, the heater unit 11 may be provided with a rotating mechanism that automatically rotates the heater 30 and the heater holding member 32.

What is claimed is:

1. An inkjet printer, comprising:

an inkjet head for a printing operation by way of discharging an ink drop onto a medium;

a heater for heating up the medium after the printing operation;

a second heater for further heating up the medium after the medium is heated up by the heater;

a frame to which the second heater is fixed; and a wound roll holder for holding a wound roll that is the medium, being wound like a roll after the printing operation, wherein an axial direction of the wound roll is represented as a right-and-left direction, and a direction perpendicular to a vertical direction and the right-and-left direction is represented as a front-and-back direction, the wound roll is placed at a position lower than the heater, and the second heater is movable in relation to the frame, between a first position and a second position, the first position is a position where the second heater is placed at a location of a lower side of the heater and a front side of the wound roll, and the second position is a position where the second heater is placed at a location of an upper side of the wound roll.

2. The inkjet printer according to claim 1, wherein the second heater is rotatable in relation to the frame, with the right-and-left direction as the axial direction of a rotary movement, between the first position and the second position.

3. The inkjet printer according to claim 2, wherein at a time when the second heater is placed at the second position, the second heater and the heater face each other across a clearance, and the medium after the printing operation passes through between the second heater and the heater.

4. The inkjet printer according to claim 2, wherein the inkjet printer further comprises:

a cable, connected to the second heater; and a heater holding member to which an end part of the second heater in the right-and-left direction is fixed, wherein the cable is led from the heater holding member, outward in the right-and-left direction.

5. The inkjet printer according to claim 4, wherein in the second heater, there is provided a medium contacting surface that the medium contacts at a time when the second heater is placed at the first position.

6. The inkjet printer according to claim 2, wherein in the second heater, there is provided a medium contacting surface that the medium contacts at a time when the second heater is placed at the first position.

7. The inkjet printer according to claim 3, wherein the inkjet printer further comprises:

a cable, connected to the second heater; and a heater holding member to which an end part of the second heater in the right-and-left direction is fixed, wherein the cable is led from the heater holding member, outward in the right-and-left direction.

8. The inkjet printer according to claim 3, wherein in the second heater, there is provided a medium contacting surface that the medium contacts at a time when the second heater is placed at the first position.

9. The inkjet printer according to claim 7, wherein in the second heater, there is provided a medium contacting surface that the medium contacts at a time when the second heater is placed at the first position.

10. The inkjet printer according to claim 1, wherein in the second heater, there is provided a medium contacting surface that the medium contacts at a time when the second heater is placed at the first position.

* * * * *